US005309680A

United States Patent [19]

Kiel

[11] Patent Number: 5,309,680

[45] Date of Patent: May 10, 1994

[54] MAGNETIC SEAL FOR REFRIGERATOR HAVING DOUBLE DOORS

[75] Inventor: Lowell M. Kiel, Seymour, Ind.

[73] Assignee: The Standard Products Company, Cleveland, Ohio

[21] Appl. No.: 944,498

[22] Filed: Sep. 14, 1992

[51] Int. Cl.[5] ..... E06B 7/16

[52] U.S. Cl. ..... 49/478.1; 49/368

[58] Field of Search ..... 49/475, 478, 484, 486, 49/368; 292/DIG. 71, 251.5, DIG. 72; 312/296, 405

[56] References Cited

U.S. PATENT DOCUMENTS

| | | | |
|---|---|---|---|
| 2,565,891 | 8/1951 | Sherman | 292/251.5 |
| 2,723,896 | 11/1955 | Wurtz . | |
| 3,004,309 | 10/1961 | Korodi . | |
| 3,077,644 | 2/1963 | Kesling . | |
| 3,216,776 | 11/1965 | Carbary | 49/478 X |
| 3,248,159 | 4/1966 | Hall . | |
| 3,362,108 | 1/1968 | Jones . | |
| 3,408,772 | 11/1968 | Frehse . | |
| 3,465,536 | 9/1969 | Vogel et al. . | |
| 3,487,581 | 1/1970 | Ellingson, Jr. . | |
| 4,702,038 | 10/1987 | Frey . | |
| 4,732,432 | 3/1988 | Keil et al. | 312/296 X |
| 4,832,396 | 5/1989 | Moreno et al. | 49/478 X |

FOREIGN PATENT DOCUMENTS

| | | | |
|---|---|---|---|
| 2846629 | 4/1980 | Fed. Rep. of Germany | 49/428 |

*Primary Examiner*—Peter M. Cuomo
*Assistant Examiner*—Jerry Redman
*Attorney, Agent, or Firm*—Harness, Dickey & Pierce

[57] ABSTRACT

A magnetic seal is disclosed for releasably sealing two doors arranged side by side on a thermally insulated cabinet such as a refrigerator or freezer. A retainer gasket is affixed to the inner edge of each door. One of the retainer gasket encloses a magnet and retains the magnet fixed in place relative to the door. Another retainer gasket is affixed to the other door and is formed of a base, a sleeve enclosing a second magnet, and two flexible webs connecting the sleeve to the base. The retainer gaskets and magnets are arranged so that the magnets impart an attractive force on each other and releasably seal the doors. When one of the doors is opened slightly, the magnets are arranged to repel each other and assist in easily opening at least one of the doors. Finally, a magnet having more than two magnetic poles may be used to assist in sealing and opening at least one of the doors.

11 Claims, 3 Drawing Sheets

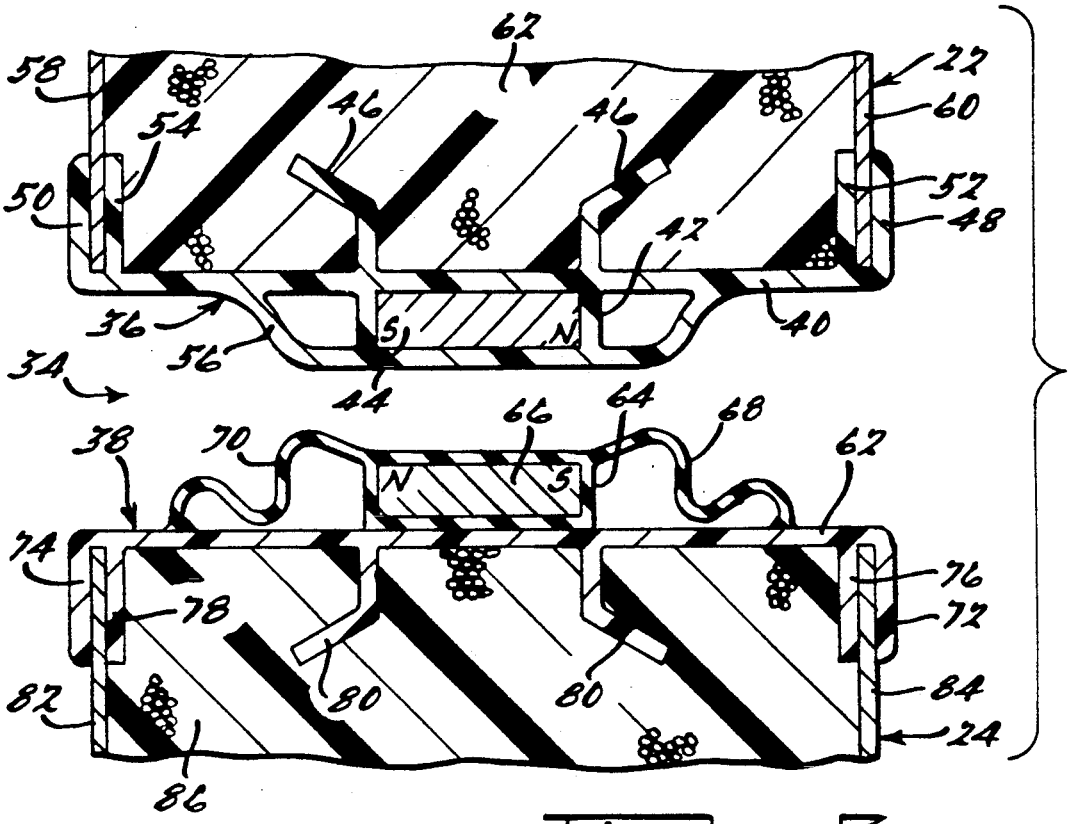
FIG. 3.
FIG. 4.
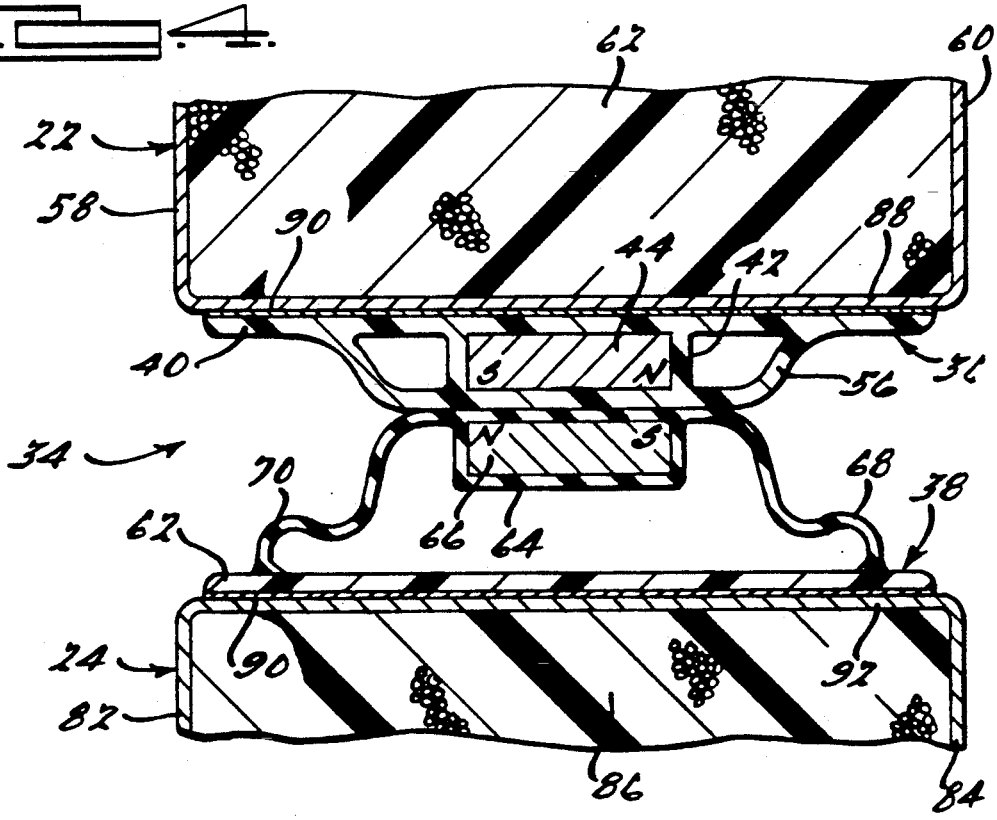

MAGNETIC SEAL FOR REFRIGERATOR HAVING DOUBLE DOORS

BACKGROUND OF THE INVENTION

1. Technical Field

This invention relates generally to a thermally insulated container provided with at least two doors, and more particularly to a dual magnetic seal for releasably sealing the edges of two doors of a thermally insulated cabinet.

2. Discussion

Refrigerators and freezers are often assembled having at least two doors located side by side, each door having a hinge along its outer edge and a handle proximate to its inner edge in a "French Door" arrangement. The doors must be releasably sealed when in a closed position to maintain a low temperature inside the cabinet and to prevent heat transfer with the ambient atmosphere. This releasable seal is generally formed as a magnetic gasket at the edge of the door for releasably sealing the edge of the door to a metal pole or bridge between separate compartments of the insulated cabinet.

SUMMARY OF THE INVENTION

According to a preferred embodiment of the present invention, a dual magnetic seal is disclosed for releasably sealing two doors of a thermally insulated cabinet, such as a refrigerator or freezer. The doors are mounted to the cabinet in a "French Door" arrangement, each door being mounted side by side and being affixed to the cabinet by means of hinges located at the outer edges of the doors. A retainer gasket is affixed to the inner edge of each door opposite each hinge. One retainer gasket encloses and surrounds a magnet such that the magnet is affixed in place relative to one of the doors. Another retainer gasket is affixed to the other door, and has a sleeve for enclosing and surrounding another magnet and a base portion, as well as two flexible webs connecting the sleeve and base. The flexible webs allow the second magnet to move in a transverse direction toward and away from the edge of the second door.

When the doors are closed, the magnets impart an attractive force on each other, and the second magnet moves transversely away from the edge of the second door and toward the first magnet. When the doors are open, the magnets impose substantially no force on each other. When the doors are in a position intermediate of the closed and open positions, the magnets are arranged so that they impart a repelling force on each other, and the second magnet moves transversely toward the edge of the second door and away from the first magnet, assisting in the opening of the door. As a result, the magnets effect a releasable seal when the doors are in the closed position. When the doors are opened slightly, the magnets repel each other and assist further in opening the doors.

Finally, the magnetic seal of the present invention may include at least one magnet having more than two magnetic poles. Such a "multi-pole" magnet may be used to further assist in sealing and opening at least one of the doors.

BRIEF DESCRIPTION OF THE DRAWINGS

The various advantages and features will become apparent from the following description and claims, in conjunction with the accompanying drawings:

FIG. 3 is a cut-away top view of the magnetic seal of the present invention, showing the double doors in a closed position;

FIG. 4 is a cut-away top view similar to FIG. 3 of an alternative embodiment of the present invention;

DETAILED DESCRIPTION OF THE PREFERRED EMBODIMENTS

The following description of the preferred embodiments is merely exemplary in nature and is in no way intended to limit the invention or its application or uses.

Figure 1:
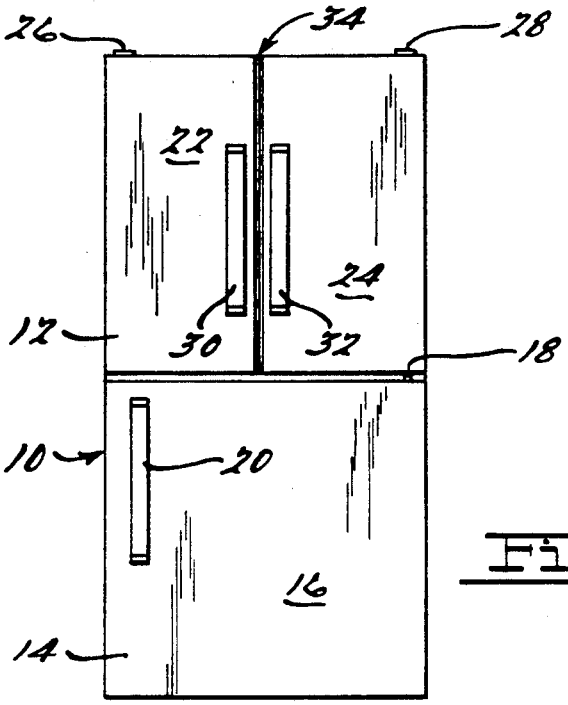
FIG. 1 is a front view of a refrigerator and freezer having the magnetic seal of the present invention.
Figure 2:
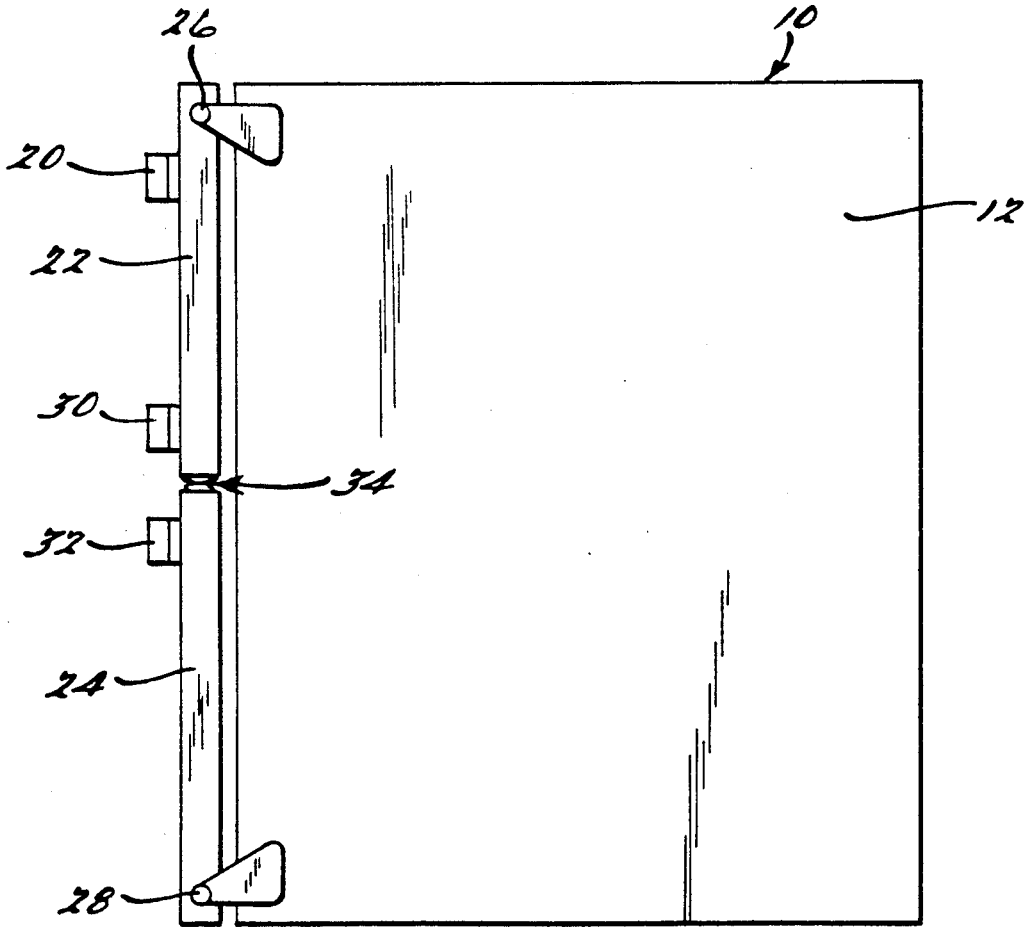
FIG. 2 is a top view of the refrigerator and freezer of FIG. 1.

Referring to the drawings, a thermally insulated cabinet 10 is shown in FIG. 1, having a refrigerator 12 and freezer 14. Freezer 14 has a door 16 mounted to the insulated cabinet 10 by means of a hinge 18. Freezer door 16 has a handle 20 and a magnetic seal (not shown) for releasably sealing door 16 in a closed position. Refrigerator 12 has two doors 22 and 24 mounted to insulated cabinet 10 by means of hinges 26 and 28, respectively. Refrigerator doors 22 and 24 each have a handle 30 and 32 for use in opening the doors 22 and 24. The inner edges of doors 22 and 24 are releasably sealed by a magnetic seal 34, according to the present invention.

Magnetic seal 34 is shown in greater detail in FIG. 3 and includes a first retainer gasket 36 and a second retainer gasket 38. Retainer gasket 36 is constructed of a base portion 40, a sleeve 42 enclosing a first magnet 44, anchoring ribs 46, side walls 48 and 50, retaining ribs 52 and 54, and cushioning bumpers 56. Retainer gasket 36 is fixed to door 22, which is formed of an outer shell 58, an inner door liner or pan 60 defining a region which is substantially filled with insulation 62. Side walls 48, 50 and retaining ribs 52, 54 cooperate to form clips which slide upon and grip the edges of door shell 58 and pan 60. Retainer gasket 36 is more firmly affixed in place by anchoring ribs 46 which extend into and are embedded within insulation 62. Retainer gasket 36 maintains magnet 44 stationary and fixed in place relative to door 22.

Retainer gasket 38 is constructed of a base 62, a sleeve 64 enclosing a second magnet 66, flexible webs 68 and 70 connecting sleeve 64 and base 62, side walls 72 and 74, retaining ribs 76 and 78, and anchoring ribs 80. Door 24 is constructed of a shell 82 and a pan 84 defining an inner region substantially filled with insulation 86. Retainer gasket 38 is affixed to door 24 in a similar manner as retained gasket 36, by means of clips formed by side walls 72, 74 and retaining ribs 76, 78, as well as anchoring ribs 80 extending into and being held in place by insulation 86. Flexible webs 68 and 70 allow sleeve 64 and magnet 66 to move in a transverse direction away from or toward door 24.

Doors 22 and 24 are shown in a closed position in FIGS. 3 and 4. Magnets 44 and 66 are preferably arranged as shown with north and south magnetic poles of magnet 44 being proximate to opposing south and north magnetic poles, respectively, of magnet 66 when doors 22 and 24 are in the closed position. When in the closed position, magnets 44 and 66 impart an attracting force on each other, thus moving magnet 66 transversely outward away from door 24 and toward magnet 44, until sleeve 64 and 42 make contact, thereby releasably sealing doors 22 and 24.

Figure 5:
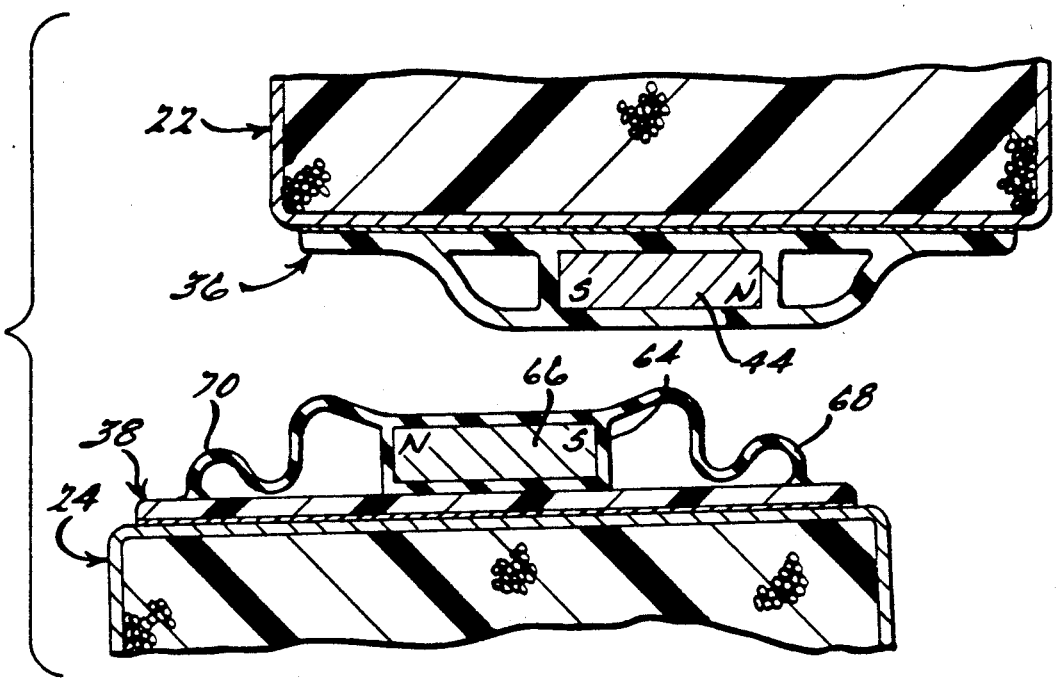
FIG. 5 is a view similar to FIG. 4, in which one door has been opened slightly.
Figure 6:
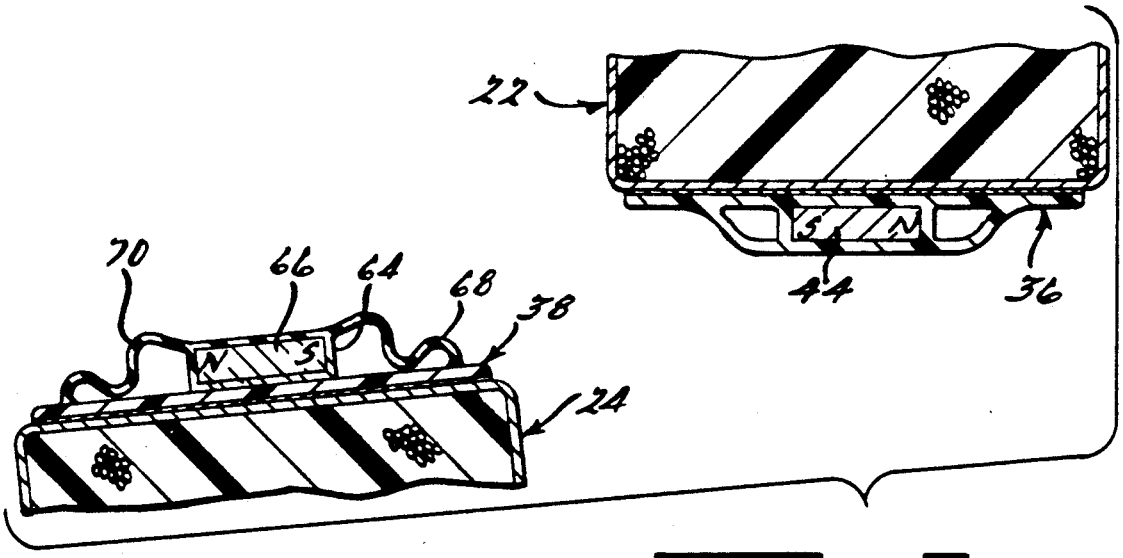
FIG. 6 is a cut-away top view similar to FIG. 5 in which a door has been opened.

Magnetic seal 34 is formed to assist in opening and closing door 22 or 24. FIGS. 5 and 6 show in even greater detail the operation of magnetic seal 34 in the case of opening of door 24 only. When door 24 is opened slightly, magnet 66 is moved in a lateral direction with respect to magnet 44. As a result, common magnetic poles of magnets 44 and 66 (south poles are shown) move into relative proximity. The common magnetic poles of magnets 44 and 66 therefore repel each other and flexible webs 68 and 70 allow magnet 66 to move transversely inward toward door 24. As a result, when either door 22 or 24 is opened slightly, the movable elements of retainer gasket 38 (sleeve 64, magnet 66, and flexible webs 68 and 70) are all moved out of contact with retainer gasket 36, thereby affording no friction to and assisting in further opening door 24. Similarly, if door 22 is opened, the movable elements 64, 66, 68 and 70 of retainer gasket 38 move transversely inward towards door 24 and away from retainer gasket 36 in order to facilitate opening door 22. It should be noted that the arrangement of the north and south magnetic poles of magnets 44 and 66 is arbitrary and may be arranged opposite to those shown in FIGS. 3 through 7.

In FIG. 6, door 24 has been opened and magnets 44 and 66 are a sufficient distance away from each other so as to impose substantially no attractive or repelling force upon each other.

An alternative embodiment is shown in FIGS. 4, 5 and 6, in which the base 40 of retainer gasket 36 is affixed to an end plate 88 of door 22 by means of an adhesive 90. Similarly, base 62 of retainer gasket 38 may be affixed to an end plate 92 of door 24 by means of adhesive 90.

Figure 7:
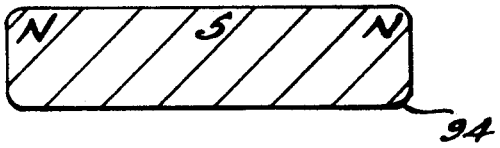
FIG. 7 is a cut-away view of a multiple pole magnet of another alternative embodiment of the present invention.

In another alternative embodiment of the present invention, magnetic seal 34 may be constructed with magnets 94 having more than two magnetic poles. For example, FIG. 7 shows a three-pole magnet 94 having two outer north poles and an inner south pole. A multi-pole magnet 94 may be used in retainer gasket 36, 38, or both. For example, a magnetic seal 34 may be constructed having a north-south-north magnet 94 enclosed within seal 64 of retainer gasket 38, and a south-north-south magnet enclosed within sleeve 42 of retainer gasket 36. The use of a multi-pole magnet may assist in providing greater attractive sealing force between the magnets of retainer gaskets 36 and 38. In addition, multi-pole magnets may more quickly reach a position in which the magnetic poles of the magnets repel each other, thus moving sleeve 64 and flexible webs 68 and 70 transversely inward towards door 24 when either door 22 or 24 is opened a distance even less than that required for standard magnets 44 and 66 having only two magnetic poles.

It should be understood that an unlimited number of configurations of the magnetic seal can be realized which satisfy the requirement described above. The foregoing discussion discloses and describes merely exemplary embodiments of the present invention. One skilled in the art will readily recognized from the discussion and from the accompanying drawings and claims, that various changes, modifications and variations can be made without departing from the spirit and scope of the invention, as defined in the following claims.

What is claimed is:

1. A magnetic seal for releasably sealing a first and second door, said doors each being mounted to a thermally insulated cabinet by a first and second hinge for movement between a closed position and an open position, comprising:

a first retainer gasket extending in a lateral and longitudinal direction being affixed to said first door and enclosing a first magnet extending in said longitudinal direction, said first magnet being surrounded by said first retainer gasket, said first retainer gasket and said first magnet being affixed in a stationary position relative to said first door;

a second retainer gasket extending in said lateral and longitudinal directions being affixed to said second door and having a sleeve surrounding a longitudinally extending said second magnet and a laterally extending base portion, said sleeve being mounted to said base by first and second flexible webs so as to allow said sleeve to move in a transverse direction;

said retainer gaskets and magnets being arranged in opposing and proximate relationship when said doors are in said closed position, said retainer gaskets and magnets being spaced apart when said doors are in said open position;

said first and second magnets being arranged so as to impose an attracting force on each other and thereby to move said second magnet transversely toward said first magnet when said doors are in said closed position, thereby releasably sealing said door in said closed position; and said magnets being arranged so as to impose substantially no force on each other when said doors are in said open position and so as to impose a repelling force on each other and to move said second magnet transversely inward toward said second door when said first door in said closed position and said second door is an intermediate position between said closed and said open position.

2. A magnetic seal as set forth in claim 1, wherein said retainer gaskets are affixed to said doors by means of adhesive.

3. A magnetic seal as set forth in claim 1, wherein each said retainer gasket is affixed to one of said doors by a first and second clip being formed to clip onto an edge of an outer and inner door component, respectively.

4. A magnetic seal as set forth in claim 3, wherein each said retainer gasket is formed with at least one anchoring rib, said rib extending into and being held in place by insulation substantially filling a region between said inner and outer door components.

5. A magnetic seal as set forth in claim 1, wherein at least one of said magnets is formed having more than two magnetic poles.

6. A magnetic seal for releasably sealing a first and second door, said doors each being mounted to a thermally insulated cabinet by a first and second hinge for movement between a closed position and an open position, comprising:

a first retainer gasket extending in a lateral and longitudinal direction being affixed to said first door by a first and second longitudinally extending clip defining a channel for accepting and clipping onto an edge of an outer and inner door component, respectively, said first retainer gasket enclosing a first magnet extending in said longitudinal direction, said first magnet being surrounded by said first retainer gasket;

a second retainer gasket extending in said lateral and longitudinal directions being affixed to said second door by a first and second longitudinally extending clip defining a channel for accepting and clipping onto an edge of an outer and inner door component, respectively, said second retainer gasket having a sleeve surrounding a longitudinally extending second magnet and a laterally extending base portion, said sleeve being mounted to said base by first and second flexible webs so as to allow said sleeve to move in a transverse direction;

each said retainer gasket being formed with at least one anchoring rib, said rib extending into and being held in a stationary position with respect to one of said doors by insulation substantially filling a region between said inner and outer door components;

said retainer gaskets and magnets being arranged in opposing and proximate relationship when said doors are in said closed position, said retainer gaskets and magnets being spaced apart when said doors are in said open position;

said first and second magnets being arranged so as to impose an attracting force on each other and thereby to move said second magnet transversely towards said first magnet when said doors are in said closed position, thereby releasably sealing said door in said closed position;

said magnets being arranged so as to impose substantially no force on each other when said doors are in said open position and so as to impose a repelling force on each other and to move said second magnet transversely inward towards said second door when said first door is in said closed position and said second door is in an intermediate position between said closed and said open positions; and said magnets having more than two magnetic poles, corresponding opposite poles of said first and second magnets being in adjacent opposing relationship when said doors are in said closed position.

7. A magnetic seal as set forth in claim 6, wherein said first retainer gasket and said first magnet are affixed in place relative to said first door.

8. A magnetic seal for releasably sealing a first and second door, said doors each being mounted to a thermally insulated cabinet by a first and second hinge for movement between a closed position and an open position, comprising:

a first retainer gasket extending in a lateral and longitudinal direction being affixed to said first door and enclosing a first magnet extending in said longitudinal direction, said first magnet being surrounded by said first retainer gasket, said first retainer gasket and said first magnet being affixed in a stationary position relative to said first door;

a second retainer gasket extending in said lateral and longitudinal directions being affixed to said door and having a sleeve surrounding a longitudinally extending said second magnet and a laterally extending base portion, said sleeve being mounted to said base by first and second flexible webs so as to allow said sleeve to move in a transverse direction;

said retainer gaskets and magnets being arranged in opposing and proximate relationship when said doors are in said closed position, said retainer gaskets and magnets being spaced apart when said doors are in said open position;

said first and second magnets being arranged so as to impose an attracting force on each other and thereby to move said second magnet transversely toward said first magnet when said doors are in said closed position, thereby releasably sealing said door in said closed position;

said magnets being arranged so as to impose substantially no force on each other when said doors are in said open position and so as to impose a repelling force on each other and to move said second magnet transversely inward toward said second door when said first door in said closed position and said second door is an intermediate position between said closed and said open position; and said magnets having more than two magnetic poles, corresponding opposite poles of said first and second magnets being in adjacent opposing relationship when said doors are in said closed position.

9. A magnetic seal as set forth in claim 8, wherein said retainer gaskets are affixed to said doors by means of adhesive.

10. A magnetic seal as set forth in claim 8, wherein each said retainer gasket is affixed to one of said doors by a first and second clip being formed to clip onto an edge of an outer and inner door component, respectively.

11. A magnetic seal as set forth in claim 10, wherein each retainer gasket is formed with at least one anchoring rib, said rib extending into and being held in place by insulation substantially filling a region between said inner and outer door components.

* * * * *